US009359875B2

(12) United States Patent
Hallundbæk

(10) Patent No.: US 9,359,875 B2
(45) Date of Patent: Jun. 7, 2016

(54) ARTIFICIAL LIFT TOOL

(75) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 317 days.

(21) Appl. No.: 13/977,054

(22) PCT Filed: Dec. 29, 2011

(86) PCT No.: PCT/EP2011/074214
§ 371 (c)(1),
(2), (4) Date: Jun. 28, 2013

(87) PCT Pub. No.: WO2012/089802
PCT Pub. Date: Jul. 5, 2012

(65) Prior Publication Data

US 2013/0277065 A1 Oct. 24, 2013

(30) Foreign Application Priority Data

Dec. 30, 2010 (EP) ..... 10197360

(51) Int. Cl.
*E21B 43/00* (2006.01)
*E21B 43/12* (2006.01)

(52) U.S. Cl.
CPC ..... *E21B 43/121* (2013.01); *E21B 43/128* (2013.01)

(58) Field of Classification Search
CPC . E21B 43/121; E21B 43/128; F04D 13/0633; F04D 29/046
USPC ..... 166/106, 368, 372, 68
See application file for complete search history.

(56) References Cited

U.S. PATENT DOCUMENTS

| | | | | |
|---|---|---|---|---|
| 2,667,128 | A * | 1/1954 | Bergh | F04D 1/063 415/110 |
| 3,468,258 | A | 9/1969 | Arutunoff | |
| 3,807,894 | A * | 4/1974 | O'Rourke | E21B 34/08 137/513 |
| 5,033,937 | A | 7/1991 | Wilson | |
| 5,660,520 | A * | 8/1997 | Scarsdale | E21B 43/128 415/104 |
| 5,820,271 | A | 10/1998 | Hackett | |
| 6,167,965 | B1 * | 1/2001 | Bearden | E21B 43/121 166/105.5 |
| 2002/0187037 | A1 * | 12/2002 | Lee | E21B 43/128 415/1 |
| 2004/0144534 | A1 * | 7/2004 | Lee | E21B 43/128 166/265 |

(Continued)

FOREIGN PATENT DOCUMENTS

| | | | |
|---|---|---|---|
| CN | 101070857 | A | 11/2007 |
| CN | 101273201 | A | 9/2008 |

(Continued)

OTHER PUBLICATIONS

International Search Report for PCT/EP2011/074214 mailed Mar. 9, 2012.

(Continued)

*Primary Examiner* — Kenneth L Thompson
*Assistant Examiner* — Michael Wills, III
(74) *Attorney, Agent, or Firm* — Nixon & Vanderhye P.C.

(57) ABSTRACT

The present invention relates to an artificial lift tool for being introduced in a wellbore or a casing and submerged in well fluid. The artificial lift tool extends in a longitudinal direction from a top end adapted to be connected to a wireline to a bottom end. The tool comprises a motor unit and a pump unit. Furthermore, invention relates to a production well wherein the artificial lift tool is submerged in a well fluid; to the use of the artificial lift tool for providing artificial lift in a well; and to a method for providing artificial lift in a well.

15 Claims, 8 Drawing Sheets

(56) References Cited

U.S. PATENT DOCUMENTS

| | | | | |
|---|---|---|---|---|
| 2006/0243450 | A1 | 11/2006 | Head | |
| 2008/0196902 | A1* | 8/2008 | Head | E21B 33/1275 166/381 |
| 2009/0035161 | A1 | 2/2009 | Grann et al. | |
| 2009/0145612 | A1 | 6/2009 | Olson et al. | |
| 2009/0159262 | A1 | 6/2009 | Gay et al. | |
| 2009/0202371 | A1* | 8/2009 | Green | E21B 43/128 417/423.3 |
| 2009/0267435 | A1 | 10/2009 | Appel | |
| 2010/0143166 | A1 | 6/2010 | Head | |
| 2010/0150751 | A1* | 6/2010 | Merrill | E21B 43/128 417/410.1 |
| 2011/0044831 | A1* | 2/2011 | Cunningham | F04D 1/063 417/410.1 |

FOREIGN PATENT DOCUMENTS

| | | | |
|---|---|---|---|
| CN | 201180680 | Y | 1/2009 |
| JP | 9-317678 | A | 12/1997 |
| WO | WO 2009/137316 | | 11/2009 |

OTHER PUBLICATIONS

Written Opinion of the International Searching Authority mailed Mar. 9, 2012.

Office Action mailed May 29, 2015 in Chinese Application No. 201180063335.2, with English translation (11 pages).

International Preliminary Report on Patentability issued in International Application No. PCT/EP2011/074214 dated Jul. 11, 2013.

* cited by examiner

ARTIFICIAL LIFT TOOL

This application is the U.S. national phase of International Application No. PCT/EP2011/074214 filed 29 Dec. 2011 which designated the U.S. and claims priority to EP 10197360.0 filed 30 Dec. 2010, the entire contents of each of which are hereby incorporated by reference.

FIELD OF THE INVENTION

The present invention relates to an artificial lift tool for being introduced in a wellbore or a casing and submerged in well fluid. The artificial lift tool extends in a longitudinal direction from a top end adapted to be connected to a wireline to a bottom end. The tool comprises a motor unit and a pump unit. Furthermore, the invention relates to a production well wherein the artificial lift tool is submerged in a well fluid; to the use of the artificial lift tool for providing artificial lift in a well; and to a method for providing artificial lift in a well.

BACKGROUND ART

During oil and gas production, it is sometimes necessary to assist the production in a well due to a high hydro-static pressure. If the well itself is not capable of generating the sufficient pressure to drive oil or gas to the surface, or the well has been deliberately killed, a tool may be used to lift the well fluid to the upper part of the well. Such tools are often referred to as artificial lift tools.

By submerging a pump tool in a well, the pump may be used to boost the pressure or perhaps restart a dead well. The pump tool forms a plug or seal in the well and pumps well fluid from one side of the plug to the other. The pump tool has to provide the necessary pressure to overcome the static pressure of the well fluid above the pump.

An artificial lift tool operates in a harsh or "dirty" environment and pumps well fluid containing contaminants and aggressive fluids. For the tool to be operational in longer periods of time, it is crucial that such contaminants do not accumulate in the pump and that well fluid is prevented from entering vital parts of the pump.

SUMMARY OF THE INVENTION

It is an object of the present invention to wholly or partly overcome the above disadvantages and drawbacks of the prior art. More specifically, it is an object to provide an improved artificial lift tool which prevents accumulation of contaminants, especially in pumping parts and bearings of the tool.

It is also an object of the present invention to provide an artificial lift tool wherein assembly of the different parts of the tools, especially the pumping parts, is facilitated since larger tolerances of the parts may be applied, i.e. the parts may be produced with less accuracy.

The above objects, together with numerous other objects, advantages, and features, which will become evident from the below description, are accomplished by a solution in accordance with the present invention by an artificial lift tool for being introduced in a wellbore or a casing and submerged in well fluid, the artificial lift tool extending in a longitudinal direction from a top end adapted to be connected to a wireline to a bottom end, and the tool comprising:

- a motor unit comprising a torque element providing a torque output,
- a pump unit positioned below the motor unit in relation to the top end, the pump unit comprising:
  - a housing extending in the longitudinal direction and having an upper section and a lower section,
  - a pump shaft integrally connected to the torque element of the motor unit and extending through the upper and lower sections of the housing,
  - at least one pump stage connected to the pump shaft and comprising a rotor and a stator,
  - at least one inlet positioned in the lower section, and
  - a packer unit positioned on an outer surface of the housing, the packer unit being adapted to provide a circumferential seal in an annulus between the artificial lift tool and a side of the wellbore or the casing, wherein a first main bearing adapted to absorb both axial and radial forces is arranged in the upper section of the pump unit and the pump shaft is connected with the first main bearing, whereby axial forces acting on the pump shaft are mainly obtained by the first main bearing, and the pump shaft is substantially suspended from the first main bearing.

Hereby, a pump unit comprising a pump shaft which does not need to be supported in the lower section of the pump unit is provided. Supporting a shaft induces the risk of the shaft being bended, which results in more wear in the bearing. Furthermore, a simpler artificial tool design is provided.

In an embodiment, the circumferential seal may divide the wellbore or casing into an upper section and a lower, sealed-off section.

By dividing the wellbore or the casing into an upper section and lower, sealed-off section, the well fluid is forced to enter only through the pump unit of the artificial tool.

The pump stage may be connected with the pump shaft and suspended from the first main bearing via the pump shaft.

The artificial lift tool may further comprise a compensator pump fluidly connected to the first main bearing in order to pressurise the first main bearing to obtain a pressure at least substantially equal to a pressure of the well fluid.

By pressurizing the first main bearing, contaminants in the well fluid are prevented from entering and contaminating the first main bearing thereby preventing it from functioning properly.

In an embodiment, the compensator pump may be arranged above the pump unit in relation to the top end.

Furthermore, the compensator pump may be arranged above the motor unit to compensate both the motor unit and the main bearing and obtain a pressure in the motor unit at least substantially equal to a pressure of the well fluid.

Moreover, the pump stage may comprise a flow guide mounted on the rotor and/or stator to provide an optimised flow.

Additionally, the flow guide and vanes of the rotor may form a number of cavities.

Furthermore, the flow guide may be welded on the rotor and/or stator.

The flow guide prevents accumulation of contaminants, residues, scales, etc. from the well fluid in the pump unit as well as subsequent clogging, thereby increasing the efficiency of the pump unit. Further, mounting the flow guide on the rotor and/or stator allows for reduction of the tolerances of the pump components.

The pump unit may comprise a multiple stage centrifugal pump.

Moreover, the pump unit may comprise eight pump stages.

The artificial lift tool may further comprise a second main bearing positioned in the lower section of the pump unit and being adapted to mainly absorb radial forces, the pump shaft being connected to the second bearing.

Furthermore, the second bearing may a plain bearing.

Additionally, the second bearing may be a roller bearing.

Also, the first main bearing may be a ceramic bearing.

In an embodiment, the pump shaft may have a hollow bore extending in the longitudinal direction of the housing.

Moreover, the compensator pump may be fluidly connected to the second main bearing in order to pressurise the second main bearing to obtain a pressure at least substantially equal to the pressure in the well.

In addition, the tool may comprise pressure means for pressurizing the packer unit during sealing of the annulus.

Also, the tool may comprise a mechanical system for activating the packer unit during sealing of the annulus.

Additionally, the artificial lift tool as described above may comprise a compensator unit fluidly connected to the second main bearing in order to supply the second main bearing with fluid and to obtain a pressure at least substantially equal to a pressure of the well fluid.

Said compensator unit may comprise a piston member and a spring member pushing the piston member in the longitudinal direction, the piston member being adapted to pressurise a fluid inside the second main bearing.

Further, one or more bearings may be compressed by a spring member.

The invention furthermore relates to a production well wherein an artificial lift tool as described above is submerged in a well fluid, the artificial lift tool being adapted to pump the well fluid from a lower sealed-off section of the well below the artificial lift tool to an upper section of the well above the artificial lift tool in order to create artificial lift in the production well.

Moreover, the invention relates to the use of an artificial lift tool as described above for providing artificial lift in a well by pumping a well fluid from a lower sealed-off section of the well below the artificial lift tool to an upper section of the well above the artificial lift tool.

Finally, the invention relates to a method for providing artificial lift in a well, comprising the steps of:

- lowering an artificial lift tool as described above into a wellbore or a casing,
- providing a seal in an annulus between the artificial lift tool and a side of the wellbore or the casing by activating a packer unit arranged on an outer surface of the artificial lift tool, and
- pumping a well fluid from a lower sealed-off section of the well below the artificial lift tool to an upper section of the well above the artificial lift tool.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
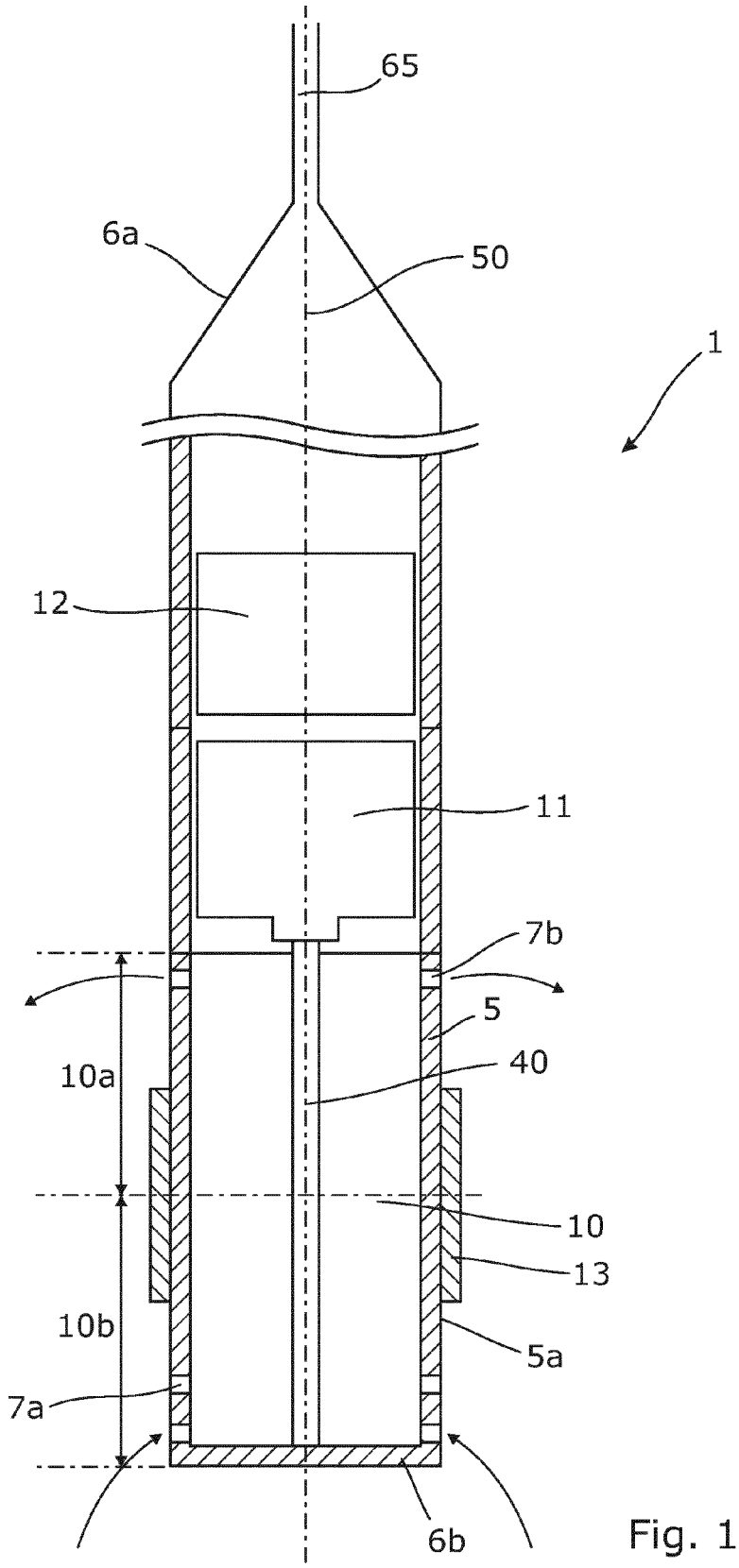
FIG. 1 shows a principal drawing of an artificial lift tool comprising a pump unit, a motor unit and a compensator pump.
Figure 2:
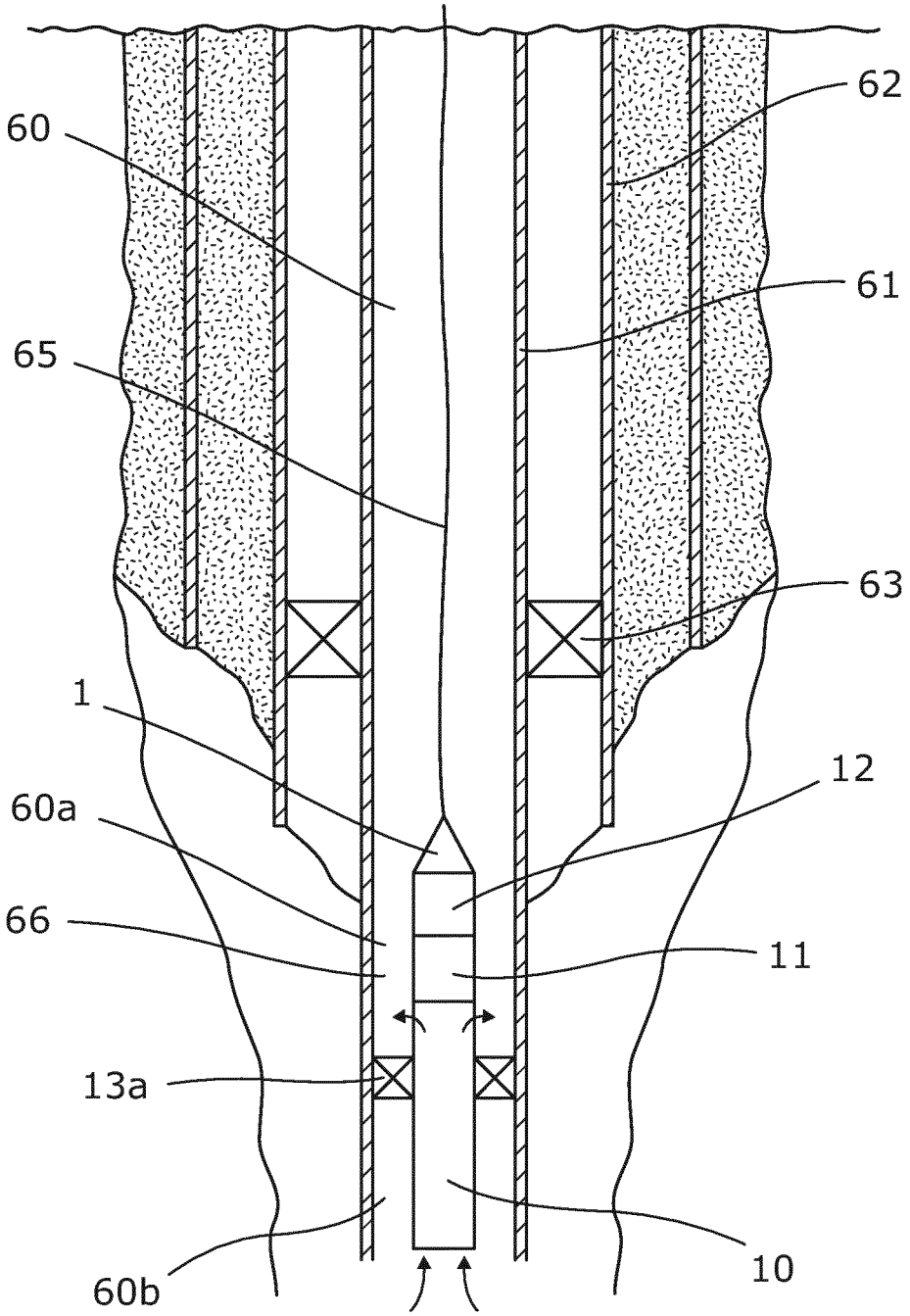
FIG. 2 shows a cross-section of a cased wellbore with an artificial lift tool provided inside the casing.

FIG. 1 shows an artificial lift tool 1 for being submerged in a well fluid in a wellbore 60, as shown in FIG. 2. The artificial lift tool 1 provides artificial lift of well fluid in a non-producing well by pumping the well fluid from a lower sealed-off section 60*b* of the well below a packer unit 13 surrounding the artificial lift tool to an upper section 60*a* of the well above the artificial lift tool.

The artificial lift tool 1 extends in a longitudinal direction 50 from a top end 6*a*, adapted to be connected to a wireline 65, to a bottom end 6*b* comprising an inlet 7*a*. The artificial lift tool 1 comprises a number of functional units which will be described in further detail below.

Reference number 10 depicts a pump unit positioned adjacent to the bottom end 6*b* of the artificial lift tool 1. The pump unit 10 comprises a housing 5 extending in the longitudinal direction, and the pump unit 10 comprises an upper section 10*a* and a lower section 10*b*. Inside the housing 5, a number of pump stages 20 are mounted on a pump shaft 40 extending from the upper section 10*a* of the pump unit 10 and into the lower section 10*b*. Each pump stage 20 comprises a rotor 21 for providing the required pumping effect and a stator 24 for directing the flow of well fluid between rotors in subsequent pump stages. Thus, the artificial lift tool 1 does not comprise a feed pump, but only one main pump, and thus, the artificial lift tool is a more efficient and simple tool than the known prior art tools.

FIG. 1 shows a packer unit 13 positioned on an outer surface 5*a* of the pump unit housing 5. The packer unit 13 extends in a periphery of the housing 5 in order to provide a circumferential seal 13*a* between the artificial lift tool 1 and a side of the wellbore 60 or casing 61 when the artificial lift tool 1 is positioned in a well. The seal divides the wellbore 60 or casing 61 into an upper section 60*a* and a lower sealed-off section 60*b*. FIG. 2 shows the packer unit 13 in an activated state, where a seal 13*a* is provided in the annulus 66 surrounding the artificial lift tool 1 by the seal 13*a* extending in a radial direction from the housing 5. The seal may be expanded by pumping well fluid into it.

Figure 3A:
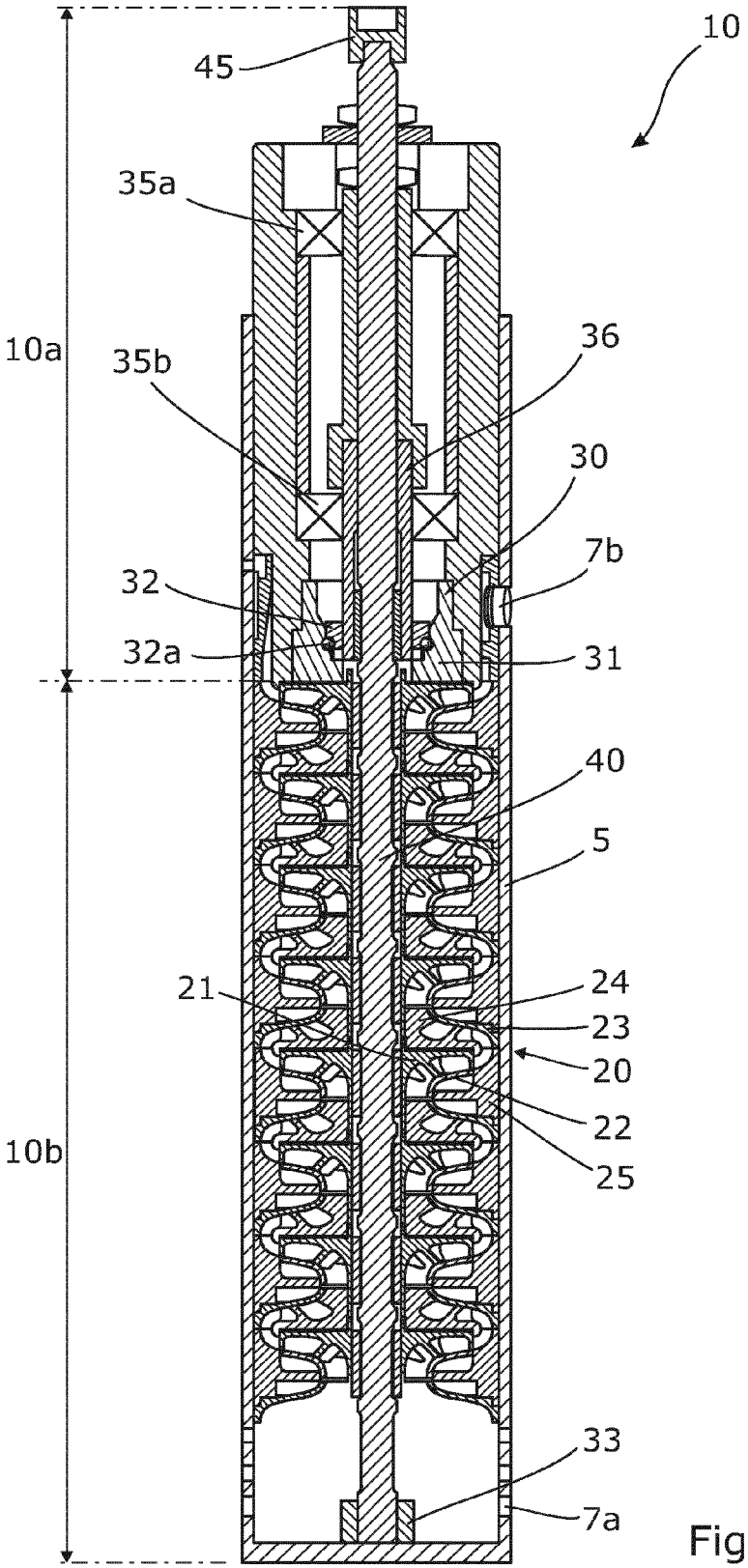
FIG. 3*a* shows a cross-section of a pump unit comprising a plurality of pumping stages.

The pump unit 10 further comprises a first main bearing 30 positioned in the upper section 10*a* of the pump unit 10 as shown in FIG. 3*a*. The first main bearing 30 is a combined axial and radial ball bearing adapted to absorb both radial and axial forces. The first main bearing 30 comprises a bearing seat 31 and a seat ring 32 with a plurality of balls 32*a* positioned between them. The seat ring 31 is connected to the pump shaft 40 via a shaft sleeve 36. By the pump shaft 40 being connected to the main bearing 30, the pump shaft 40 and pump stages 20 in the lower section 10*b* of the pump unit 10 are substantially suspended in the main bearing. Thus, the pump shaft hangs from the main bearing and downwards. The first main bearing 30 thus absorbs the majority of axial forces acting on the pump shaft 40.

To enhance the stability of the pump shaft 40, the pump unit 10 comprises a number of additional bearings 33, 35*a*, 35*b*, 35*c*. These bearings mainly absorb radial forces to prevent deflections in the pump shaft 40. A second bearing 33 is positioned in the lower section of the pump unit 10 and is designed as a plain bearing or journal bearing. The second bearing 33 has to operate in a harsh environment and is exposed to well fluid containing contaminants, residues, scales, etc. The functionality of the second main bearing 33, being capable of absorbing the majority of axial forces acting on the pump shaft, renders possible a simple second bearing design suitable for operation in such a harsh environment. The bearings 35*a*, 35*b* are ball bearings connected to the pump shaft 40 in the upper section 10*a* of the pump unit 10 above the first main bearing 30. It will be evident for a person skilled in the art that the functionality of the bearings described above may be obtained using various other types of bearings, such as, but not limited to, tapered or spherical roller bearings.

When the pump shaft 40, and thus the main weight of the pump shaft 40 and the pump stages 20, is merely suspended from the first main bearing 30 in the upper section 10*a* of the pump unit 10, the shaft is not bended unintentionally in a second bearing 33 as the second bearing arranged in the lower section 10*b* of the pump unit mainly supports the shaft at its sides. In prior art tools, the lower bearing supports the shaft, resulting in the shaft being somewhat bended, thereby increasing the risk of wear in the tool 1.

Above the pump unit 10, a motor unit 11 is arranged for providing the required input power to drive the pump unit. The motor unit 11 comprises an electrical motor having a torque element integrally connected to the pump shaft 40. The artificial lift tool 1 and the motor unit 11 are powered from the surface via an electrical conductor integrated in the wireline 65. In an alternative solution, the artificial lift tool 1 may comprise an onboard power source, such as, but not limited to, a battery. In operation, the electrical motor rotates the pump shaft 40 and pump stages 20 to create a pumping effect. In other solutions for the artificial lift tool 1, the motor unit 11 may be integrated in the pump unit 10 or be otherwise positioned. Further, the motor unit 11 may comprise a drive shaft extending into the pump unit 10, partly or fully replacing the pump shaft 40. The motor unit 11 may also comprise other types of motors.

Figure 4A:
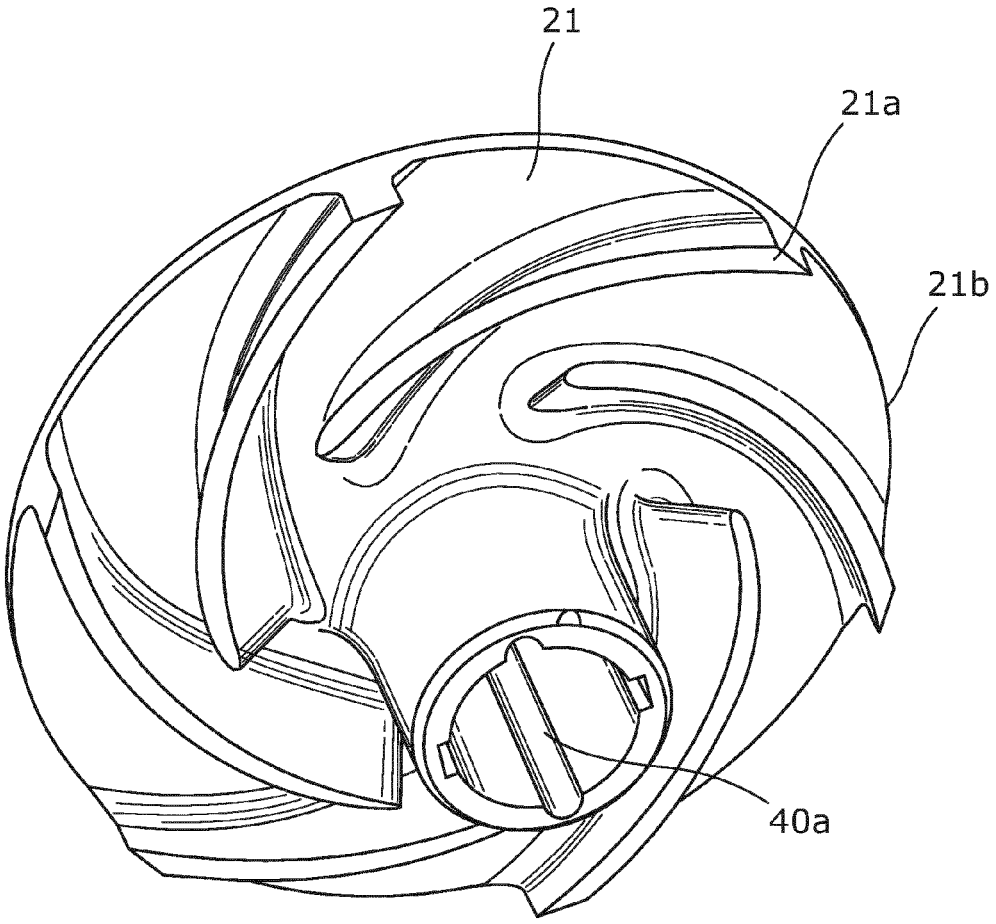
FIG. 4*a* shows a rotor.
Figure 4B:
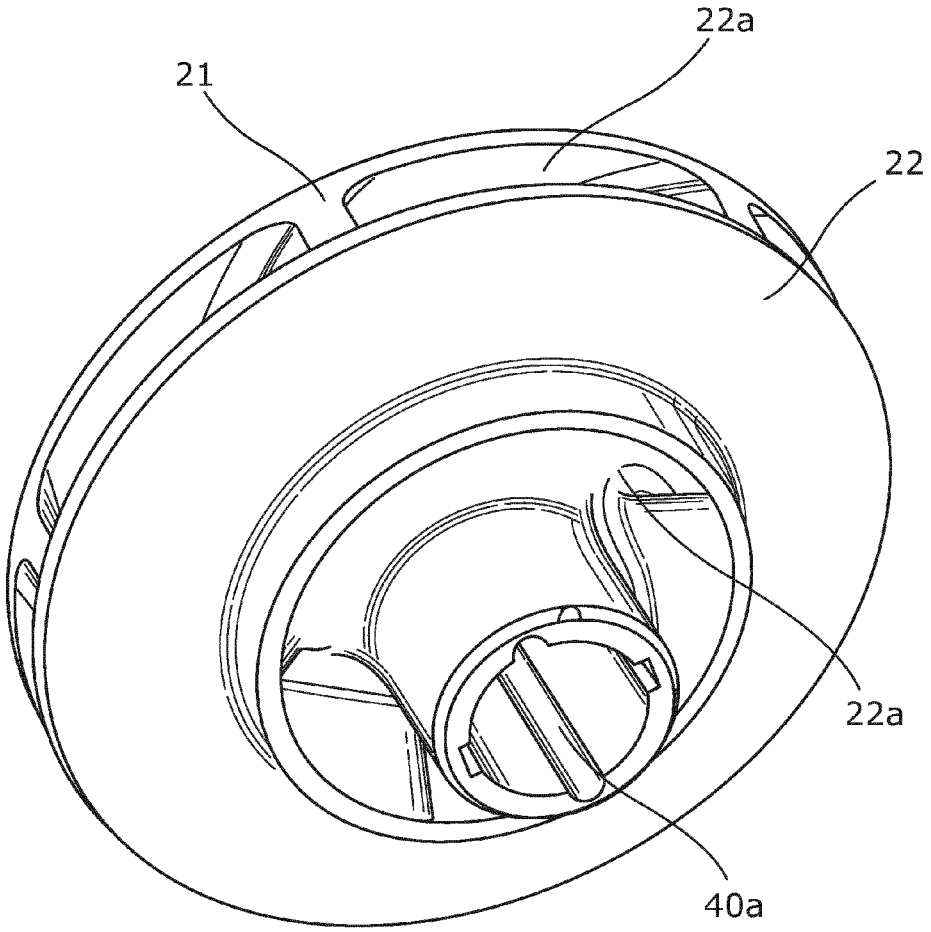
FIG. 4*b* shows a rotor with a flow guide mounted on top.

FIG. 4*b* shows a flow guide 22 mounted on the rotor 21 in order to increase the efficiency of the pump unit 10. The flow guide 22 and vanes 21*a* on the rotor 21 form a number of cavities 22*a* through which the well fluid is guided. When the pump stages 20 are mounted in the pump unit 10, the pump shaft 40 extends through a centre bore 40*a* of the rotor 21. During pumping, the well fluid enters each pump stage 20 close to the centre bore 40*a*. As the rotor 21 is rotated, the vanes 21*a* force the well fluid away from the centre and towards an outer periphery 21*b* of the rotor. The flow guide 22 is mounted on the rotor 21 as an alternative to integrating the flow guide 22 in the housing 5. This design reduces the precision and tolerances by which the housing 5 has to be manufactured since there are fewer contact points between the rotor 21 and the housing 5. Further, by providing a smooth flow path, the flow guide 22 prevents, or at least limits, accumulation of contaminants, residues, scales, etc. from the well fluid in each pump stage 20. The flow guides 22 are mounted onto the vanes 21*a* by means of welding, but another suitable mounting process could also be applied.

Figure 3B:
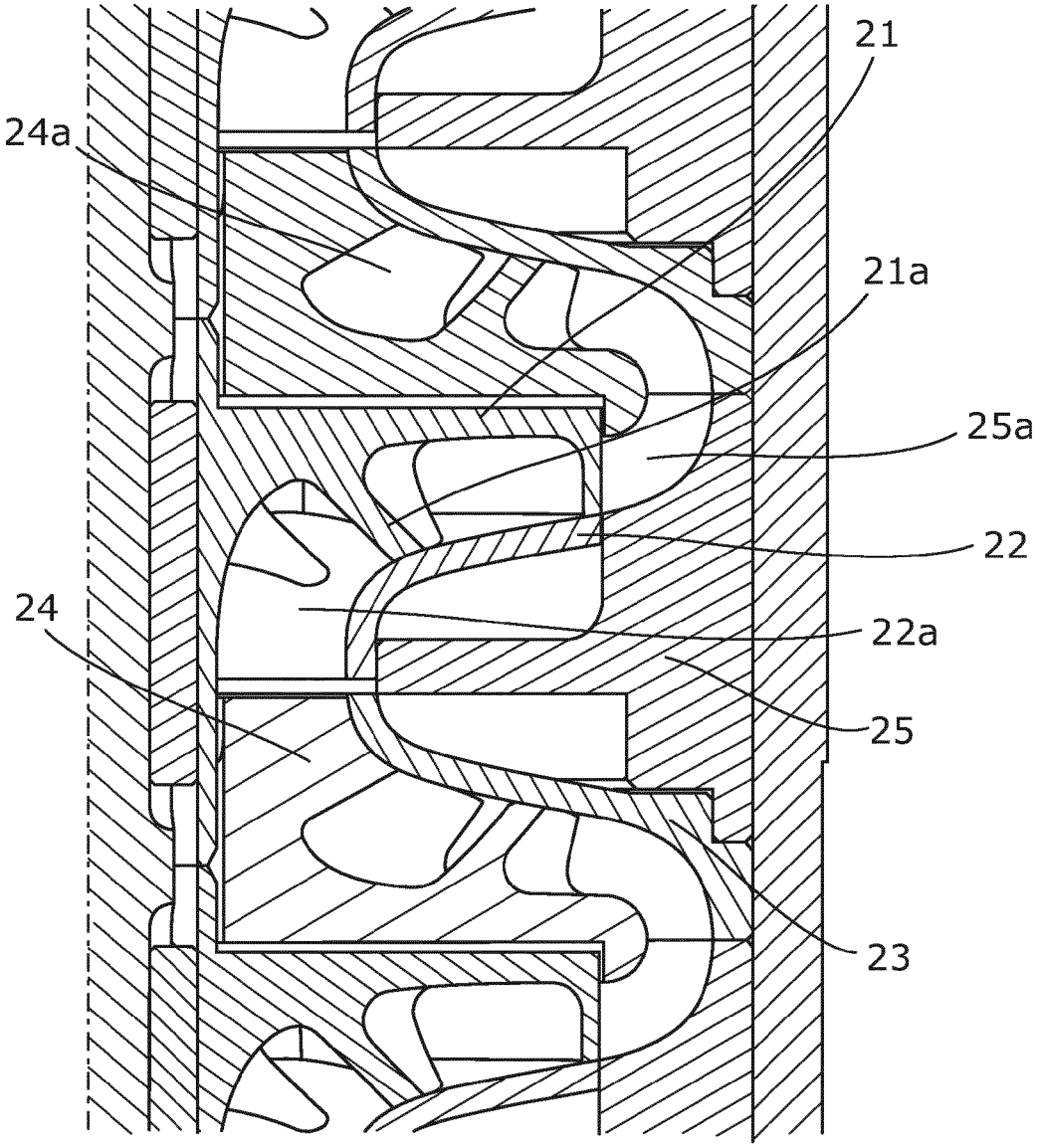
FIG. 3*b* shows a detailed section of the pumping stages of FIG. 3.

Well fluid leaving the outer periphery of the rotor 21 enters a flow channel 25*a* formed partly by a housing element 25, as shown in FIG. 3*b*. Via the flow channel 25*a*, the well fluid is guided into the part of the pump stage 20 comprising the stator 24. The stator 24 is rigidly mounted in the pump unit 10 and has a second flow guide 23 mounted on top of it. The stator 24 and the second flow guide 23 creates a flow path 24*a* guiding the well fluid from the outer periphery of the pump unit 10 towards the centre and into the next pump stage 20/rotor 21.

The well fluid from the well enters the lower section 10*b* of the pump unit 10 through one or more inlets 7*a* provided in the housing 5. The well fluid is then drawn into the first pump stage 20 and is pumped through the plurality of pump stages into the upper section 10*a* of the pump unit 10. In the upper section 10*a* of the pump unit 10, the well fluid is ejected into the well via outlets 7*b* provided in the housing 5 above the packer unit 13 and thus provides artificial lift of the well fluid in a non-producing well.

The artificial lift tool 1 further comprises a compensator pump 12 for controlling the pressure within specific parts of the artificial lift tool. The compensator pump 12 is fluidly connected to the first main bearing 30 in order to pressurise a fluid inside that bearing and provide a pressure at least substantially equal to the hydro-static pressure in the well. Hereby, accumulation of contaminants from the well fluid in the first main bearing 30 is prevented as the pressure in the main bearing is maintained at a higher level than the pressure of the surrounding "dirty" well fluid, whereby the main bearing maintains its bearings properties. The compensator pump 12 may be arranged above the pump unit 10 and thus closer to the top of the well. The compensator pump 12 may also be arranged in a way that enables it to compensate the motor unit 11 so that the pressure in the motor unit is maintained at least at the same level as the pressure of the well fluid, and thus, the compensator pump 12 may be arranged above the motor unit.

Figure 5:
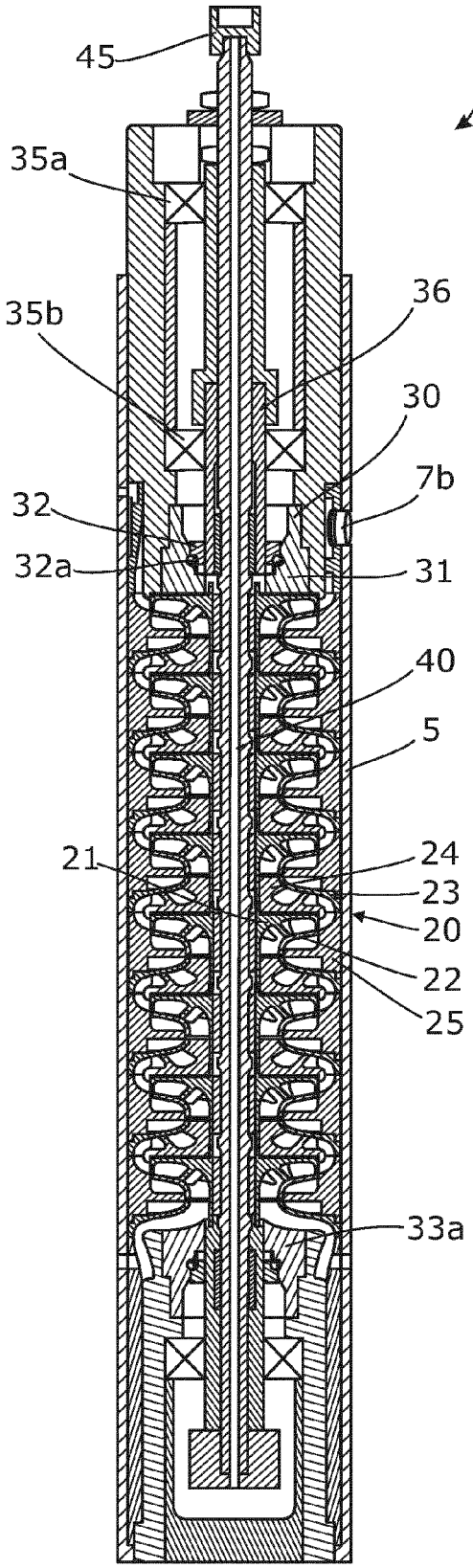
FIG. 5 shows a cross-section of a pump unit comprising a hollow pump shaft and a second main bearing.

FIG. 5 shows a pump unit 10 comprising a hollow pump shaft and a second main bearing 33*a* arranged in the lower section 10*b* of the pump unit 10. The second main bearing 33*a* is a combined axial and radial ball bearing adapted to absorb both radial and axial forces. The hollow pump shaft provides a fluid connection between the compensator pump 12 and the second main bearing 33 in order to pressurise a fluid inside the second main bearing.

Figure 6:
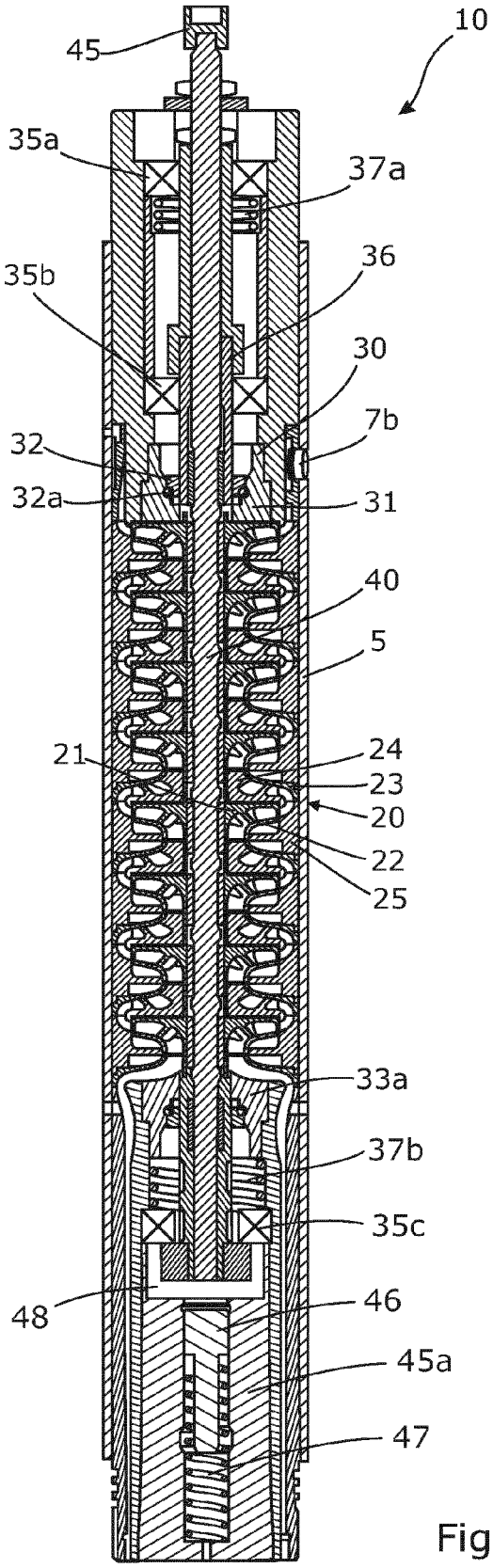
FIG. 6 shows a cross-section of another embodiment of the pump unit.

FIG. 6 shows another pump unit 10 comprising a second main bearing 33*a* and a radial bearing 35*c* arranged in the lower section 10*b* of the pump unit 10. A fluid inside the second main bearing 33*a* and the radial bearing 35*c* are supplied by a compensator 45*a* provided in the lower section 10*b*. The compensator maintains a certain overpressure in the bearing section in comparison to the wellbore pressure so that fluid inside the tool is leaking out of the tool and preventing dirty well fluid from entering the pump unit and the bearings. The compensator comprises a displacable piston 46 under the influence of a spring member 47. The piston 46 pressurises a fluid inside a cavity 48 which is in fluid communication with the second main bearing 33*a* and the radial bearing 35*c*. By the pump unit being provided with a separate compensator in the lower section, the compensator pump does not have to compensate the bearings in the lower section. Compensating both the upper and the lower section using the same system may be unsuitable in certain situations due to large variations in pressure inside the pump unit. If only one system is used, the excess pressure in some sections of the pump unit may have to be very high for the excess pressure in all sections to be above a certain threshold. A too high excess pressure inside the pump unit may result in undesirable wear and tear of components, such as gaskets, sealings, etc.

As shown in FIG. 6 the bearings 35*a* and 35*c* are both influenced by spring members 37*a*, 37*b*, in this case a helical spring. It is recognised by the skilled person that other bearings in the pump unit 10 may also be provided with any kind of spring member in a similar manner. By providing a spring slightly compressing the bearing, the operation of the bearing is improved and the lifetime prolonged.

Referring to FIG. 2, in operation, the artificial lift tool 1 is connected to a wireline 65 and lowered into a wellbore 60. When the tool 1 has reached the specified position, the packer unit 13 is activated to provide a seal 13*a* in the annulus 66 surrounding the artificial lift tool 1. The seal 13*a* divides the well into a sealed-off section 60*b* below the artificial lift tool 1 and an upper section 60*a* above the artificial lift tool.

Next, the artificial lift tool 1 is activated to pump the well fluid below the seal 13*a* to the upper section 10*b* of the well. The fluid column of well fluid in the upper section 10*b* of the well creates a hydro-static pressure on the outlet side of the pump unit 10. To create the required artificial lift, the outlet pressure of the pump unit 10 has to supersede this hydro-static pressure. Pumping well fluid from a lower side of the seal 13*a* to the upper side results in lifting of the well fluid towards the surface of the well.

The artificial lift tool 1 has different uses and may be deployed in a well for shorter or longer periods of time. If the well is at some point self-propelled or self-producing due to an increase in the well pressure and no longer needs the artificial lift provided by the artificial lift tool 1, the tool is removed from the well. The tool 1 may also be moved to a different position in the wellbore 60 or be redeployed in another well.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string etc. used downhole in relation to oil or natural gas production.

In the event that the tools are not submergible all the way into the casing, a downhole tractor can be used to push the tools all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. An artificial lift tool (1) configured for a wellbore or a casing and submerged in well fluid, the artificial lift tool extending in a longitudinal direction, a top end of the artificial lift tool adapted to be connected to a bottom end of a wireline, and the artificial lift tool comprising:

a motor unit comprising a torque element configured to provide a torque output, a pump unit positioned below the motor unit in relation to the top end, the pump unit comprising:

a housing extending in the longitudinal direction and having an upper section and a lower section (10*b*), a pump shaft integrally connected to the torque element of the motor unit and extending through the upper and lower sections of the housing, at least one pump stage connected to the pump shaft and comprising a rotor and a stator, at least one inlet positioned in the lower section, and a packer unit positioned on an outer surface of the housing, the packer unit being adapted to provide a circumferential seal in an annulus between the artificial lift tool and a side of the wellbore or the casing;

a first main bearing adapted to absorb both axial and radial forces arranged in the upper section of the pump unit and connected with the pump shaft so that axial forces acting on the pump shaft are absorbed by the first main bearing, and a compensator pump fluidly connected to the main bearing; wherein: the compensator pump is configured to pressurize the main bearing;

the pump shaft is configured to be supported by and suspended from the first main bearing during operation downhole.

2. An artificial lift tool according to claim 1, wherein the pump stage comprises a flow guide mounted on the rotor and/or stator to provide an optimised flow.

3. An artificial lift tool according to claim 2, wherein the flow guide and vanes of the rotor form a number of cavities.

4. An artificial lift tool according to claim 1, wherein the pump unit comprises a multiple stage centrifugal pump.

5. An artificial lift tool according to claim 1, wherein the pump unit comprises eight pump stages.

6. An artificial lift tool according to claim 1, further comprising a second main bearing positioned in the lower section of the pump unit and being adapted to absorb radial forces, the pump shaft being connected to the second bearing.

7. An artificial lift tool according to claim 6, further comprising a compensator unit fluidly connected to the second main bearing to supply the second main bearing with fluid and to obtain a pressure at least substantially equal to a pressure of the well fluid.

8. An artificial lift tool according to claim 1, wherein the first main bearing is a ceramic bearing.

9. An artificial lift tool according to claim 1, wherein the pump shaft has a hollow bore extending in the longitudinal direction of the housing.

10. An artificial lift tool according to claim 1, wherein the compensator pump is fluidly connected to the second bearing in order to pressurise the second bearing to obtain a pressure at least substantially equal to the pressure in the well.

11. An artificial lift tool according to claim 10, wherein the compensator unit comprises a piston member and a spring member pushing the piston member in the longitudinal direction, the piston member being adapted to pressurise a fluid inside the second main bearing.

12. An artificial lift tool according to claim 1, wherein one or more radially-acting mechanical support bearings are compressed by a spring member.

13. A production well wherein an artificial lift tool according to claim 1 is submerged in a well fluid, the artificial lift tool being adapted to pump the well fluid from a lower sealed-off section of the well below the artificial lift tool to an upper section of the well above the artificial lift tool in order to create artificial lift in the production well.

14. The artificial lift tool according to claim 1, further comprising:

a fluid chamber arranged within the lower section of the pump unit adjacent to the bottom end of the housing; and a second bearing arranged around the pump shaft within the fluid chamber;

wherein the fluid chamber is in fluid communication with and receives well fluid via the inlet.

15. A method for providing artificial lift in a well (60), comprising the steps of:

lowering an the artificial lift tool (1) according to claim 1 into the wellbore (60) or the casing sealing the annulus (66) between the artificial lift tool and the side of the wellbore (60) or the casing (61) by activating the packer unit (13) arranged on the outer surface (5*a*) of the artificial lift tool, and pumping a well fluid from a lower sealed-off section (60*b*) of the well below the artificial lift tool to an upper section (60*a*) of the well above the artificial lift tool.

* * * * *